United States Patent [19]

Bar

[11] Patent Number: 4,730,695

[45] Date of Patent: Mar. 15, 1988

[54] MUFFLER FOR HERMETIC COMPRESSOR

[75] Inventor: Alfredo Bar, Pavia, Italy

[73] Assignee: Necchi Societa per Azioni, Pavia, Italy

[21] Appl. No.: 936,256

[22] Filed: Dec. 1, 1986

[30] Foreign Application Priority Data

Jan. 10, 1986 [IT] Italy ..... 42901 A/86

[51] Int. Cl.[4] ..... F01N 1/10; F25D 19/00

[52] U.S. Cl. ..... 181/252; 181/229; 181/255; 181/256; 181/403; 417/312

[58] Field of Search ..... 181/229, 240, 252, 255, 181/256, 403; 417/312; 418/DIG. 1

[56] References Cited

U.S. PATENT DOCUMENTS

| | | | |
|---|---|---|---|
| 4,244,680 | 1/1981 | Ishizuka et al. | 418/DIG. 1 |
| 4,286,976 | 9/1981 | Eriksson | 187/358 |
| 4,330,239 | 5/1982 | Gannaway | 181/403 X |
| 4,415,060 | 11/1983 | Bar | 181/403 X |
| 4,449,610 | 5/1984 | Bar | 181/243 |
| 4,582,468 | 4/1986 | Bar | 417/312 |

*Primary Examiner*—Benjamin R. Fuller

*Attorney, Agent, or Firm*—Stevens, Davis, Miller & Mosher

[57] ABSTRACT

Muffler for hermetic compressor formed by a first portion for attenuating the pulsations and for separating the oil and by a second portion provided with means for damping the gas pulsations transmitted outwardly. A little tube permits the discharge of the oil separated from the refrigerating gas from the first or second portion.

4 Claims, 1 Drawing Figure

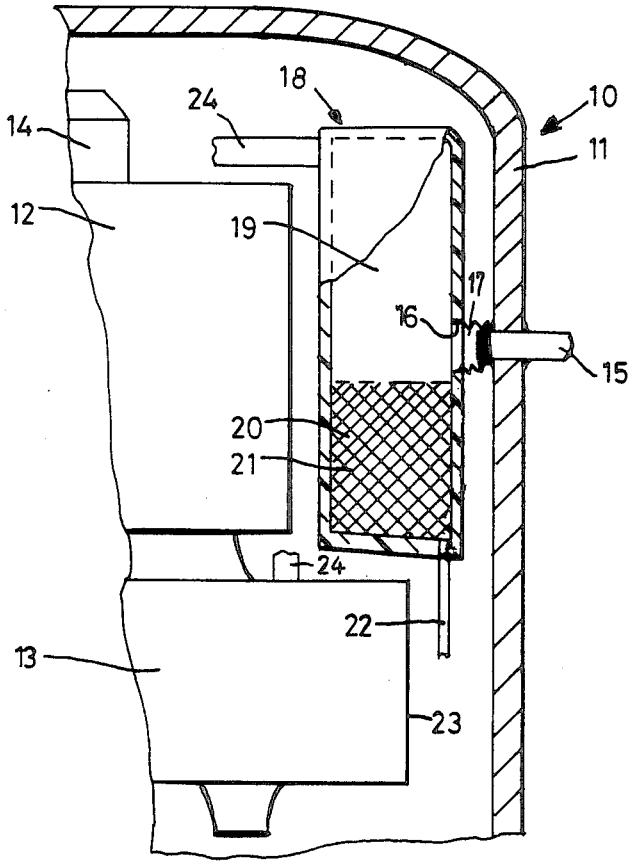
18
24
10
14
11
12
19
17
16
15
20
21
24
22
13
23

MUFFLER FOR HERMETIC COMPRESSOR

DESCRIPTION OF THE INVENTION

The present invention relates to a muffler for a hermetically sealed compressor unit and more precisely to a muffler placed on the suction part of the compressor unit.

In the suction system of a hermetically sealed compressor, where the shell is at the suction pressure, there must be a separation of the coming-back oil from the sucked refrigerant and the discharge of this oil into the shell, the maintenance of the shell at the suction pressure, the lowest possible overheating of the gas from the entrance into the shell to the entrance into the compressor, the lowest possible load losses of the gas from the entrance into the shell to the entrance into the compressor and the lowest transmission of the pulsations to the gas inside the shell in order to reduce the noise.

It is the purpose of the present invention to provide the above-mentioned effects. The technical problem to be solved was the realization of placing the muffler on the suction part while separating the oil from the refrigerant gas and, at the same time, lowering the transmission of pulsations and lowering the load losses.

The solution of the technical problem is brought about by forming the muffler in two portions, the first portion being variously shaped, to attenuate the pulsations and separate the oil from the refrigerant gas, and the second portion to damp the gas pulsations with first means being provided in the second portion for damping and second means for discharging the oil from the first or second portion.

Further characteristics and advantages will become more readily apparent from the following description and from the enclosed drawing in which the figure illustrates a vertical section of a hermetically sealed compressor unit to which the muffler of the present invention is applied.

With reference to the figure a hermetic compressor unit 10 is formed by a shell 11, an electric motor 12 mounted in a known way on the body 13 of the compressor for driving the vertical shaft 14. The relationship between the motor 12, body 13 and shaft 14 are not described as they are known in the art and do not form the object of the present invention. A little tube 15 fixed to the shell 11 conveys the refrigerant gas from the vaporizer (not illustrated in the drawings) to shell 11. The little tube 15 is in axial alignment with a bore 16 on muffler 18 placed inside the shell 11, and it is linked by a flexible connection 17 to muffler 18.

The muffler 18 is formed by a first portion indicated by 19, variously shaped, which permits the attenuation of the pulsations and the separation of the oil from the refrigerant gas and by a second portion indicated by 20, filled with porous material 21 which, by forming cavities, permits a damping of the gas pulsations transmitted outwardly and, at the same time, the discharge of the separated oil through a little tube 22.

The refrigerant gas without oil, from the first portion 19 passes into the head 23 of the compressor through the pipe 24.

The muffler damps the refrigerant gas pulsations. As many hermetically sealed compressor are mounted on springs, according to whether the muffler is placed solidly with the shell or with the compressor, the other section will be obviously flexibly connected.

I claim:

1. A hermetically sealed compressor unit comprising a shell, a compressor and muffler within said shell, said muffler being connected to the suction side of said compressor and to the shell and comprising first and second portions, said first portion being shaped to attenuate the gas pulsations of the compressor and defining an inlet for oil and refrigerant gas, said oil and gas being separated in said first portion, said second portion containing first means for damping gas pulsations and second means for discharging the oil from said first or second portion.

2. The compressor according to claim 1, wherein said first means are composed of porous material which, forming cavities, permits a damping of said gas pulsations, said porous material being a filling of said second portion.

3. The compressor according to claim 1, wherein said second means are formed by a little tube for the discharge of the oil, separated from the refrigerant gas, from said first or second portion of said muffler.

4. The compressor according to claim 1, wherein said muffler is solidly connected to the compressor and flexibly connected to the shell.

* * * * *